US006041746A

United States Patent [19]

Takemura et al.

[11] Patent Number: 6,041,746

[45] Date of Patent: Mar. 28, 2000

[54] VARIABLE VALVE ACTUATION APPARATUS

[75] Inventors: Shinichi Takemura; Seinosuke Hara; Makoto Nakamura; Yoshihiko Yamada; Keisuke Takeda; Tetsuro Goto, all of Kanagawa, Japan

[73] Assignees: Nissan Motor Co., Ltd., Yokohama; Unisia Jecs Corporation, Atsugi, both of Japan

[21] Appl. No.: 09/208,003

[22] Filed: Dec. 9, 1998

[30] Foreign Application Priority Data

Dec. 9, 1997 [JP] Japan ..... 9-338319
Mar. 18, 1998 [JP] Japan ..... 10-67526

[51] Int. Cl.[7] ..... F01L 13/00

[52] U.S. Cl. ..... 123/90.16; 123/90.17; 74/568 R

[58] Field of Search ..... 123/90.15, 90.16, 123/90.17, 90.31, 90.6; 74/568 R

[56] References Cited

U.S. PATENT DOCUMENTS

| | | | |
|---|---|---|---|
| 4,397,270 | 8/1983 | Aoyama | 123/90.16 |
| 5,899,180 | 5/1999 | Fischer | 123/90.16 |
| 5,924,334 | 7/1999 | Hara et al. | 74/568 R |
| 5,937,809 | 8/1999 | Pierik et al. | 123/90.16 |

*Primary Examiner*—Weilun Lo
*Attorney, Agent, or Firm*—Foley & Lardner

[57] ABSTRACT

A variable valve actuation (VVA) apparatus comprises a supporting arm to support a pivot center of a rocker arm. The rocker arm operates a valve operating (VO) cam in response to operation of a drive cam on an engine driven drive shaft. The supporting arm is mounted for angular motion about an axis of rotation of the drive shaft to move the pivot center of the rocker arm along a circle about the drive shaft axis. The VO cam is mounted for pivot motion about the drive shaft axis. A supporting arm (SA) actuator is provided to position the pivot center of the rocker arm to any angular position to shift mode of operation of the VVA apparatus.

9 Claims, 14 Drawing Sheets

VARIABLE VALVE ACTUATION APPARATUS

FIELD OF THE INVENTION

The present invention relates variable valve actuation (VVA) apparatuses for use in varying duration and/or lift of cylinder valves of internal combustion engines.

BACKGROUND OF THE INVENTION

U.S. Pat. No. 4,397,270 (=JP-A 55-137305) discloses a VVA apparatus. It includes a drive, a control rod with axially spaced eccentric cams, and a pivot structure. The pivot structure supports valve operating (VO) cams for pivotal motion above valve lifters of cylinder valves. Springs are mounted for the VO cams, respectively. Each of the springs biases one of the corresponding rocker cams toward its rest position where the associated cylinder valve closes. Rocker arms operate the VO cams, respectively. The eccentric cams, which are in rotary unison with the control rod, bear the rocker arms, respectively. An axis of each of the eccentric cams serves as the center of drive of the corresponding one of the rocker arms. Cams fixed to the drive shaft operate the rocker arms, respectively. An electronic controller is provided. Sensors on the engine send information on engine speed, engine load, vehicle speed, and coolant temperature to the controller. At a predetermined switchover point, the controller sends a signal to an actuator for the control rod. As the actuator turns the control rod, the eccentricity of each of the eccentric cams with respect to an axis of the control shaft changes. This alters the position of pivot center of the rocker arms relative to the position of pivot center of the VO cams. This causes variation in valve timing and lift of each of the cylinder valves.

According to this known VVA apparatus, operating angle of the VO cam increases when high lift mode is selected. The high lift mode is selected for operation at high engine speeds. The increased operating angle of the VO cam is not suitable for smooth operation of the VO cam and its associated valve lifter during operation at high speed because the VO cam is subjected to increased acceleration.

An object of the present invention is to provide a VVA apparatus wherein operating angle of VO cam is unaltered to improve smooth operation for engine operation at high speeds.

SUMMARY OF THE INVENTION

According to the present invention, there is provided a variable valve actuator (VVA) apparatus for operating a cylinder valve of an engine, comprising:

- a drive shaft having a drive shaft axis about for rotation thereabout;
- a drive cam on said drive shaft for rotation therewith about said drive shaft axis;
- a valve operating (VO) cam on said drive shaft for pivot motion about said drive shaft axis;
- a link mechanism interconnecting said drive cam and said VO cam, said link mechanism being bodily movable along a circle about said drive shaft axis; and
- an actuator to position said link mechanism to different position on said circle.

DESCRIPTION OF THE PREFERRED EMBODIMENTS

Figure 1:
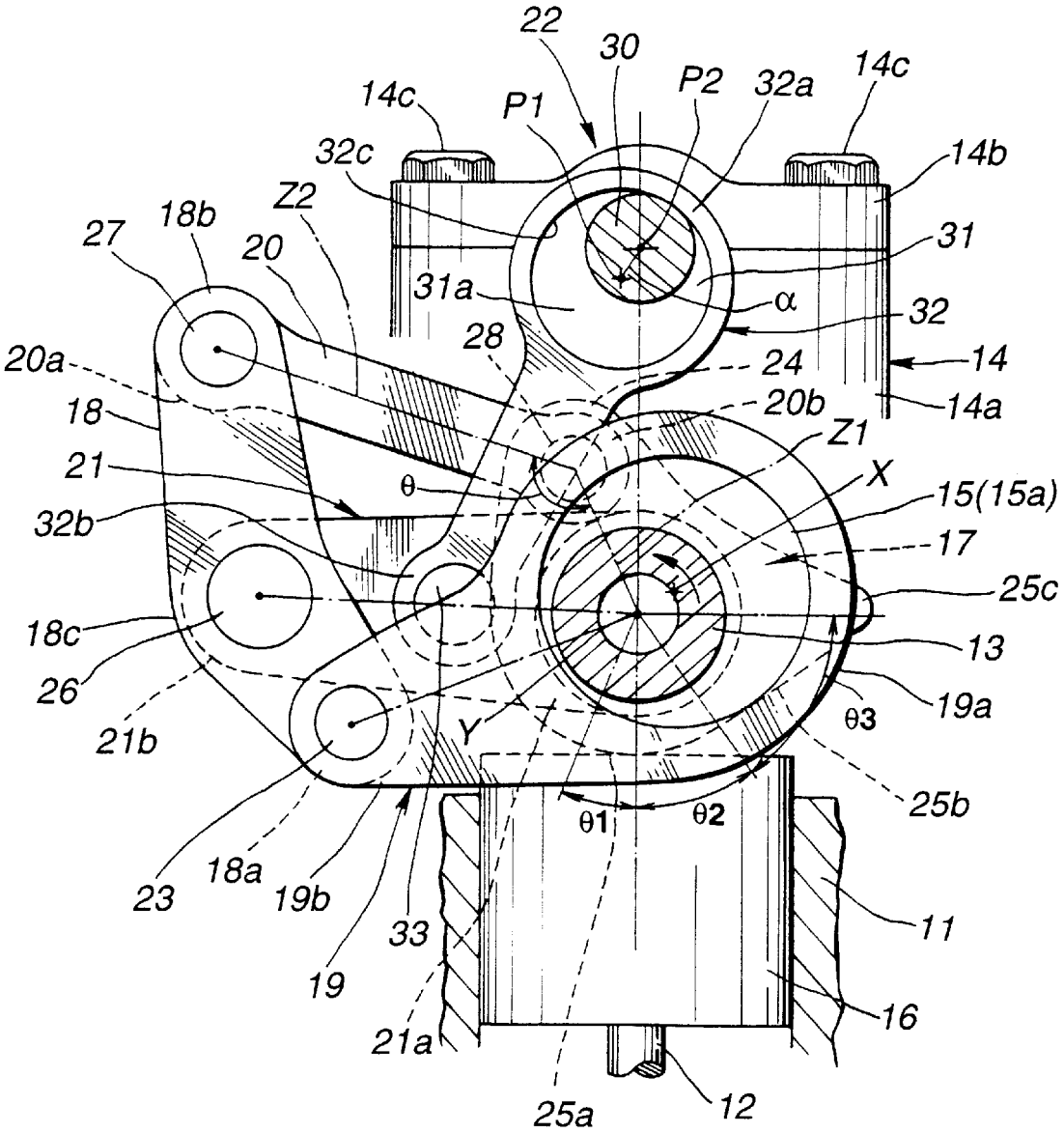
FIG. 1 is a cross section taken through the line 1—1 in FIG. 2 illustrating a first embodiment of a VVA apparatus according to the present invention.

Referring to the accompanying drawings, like reference numerals and characters are used throughout all of the Figures to denote like or similar parts or portions for the sake of simplicity of description.

Figure 2:
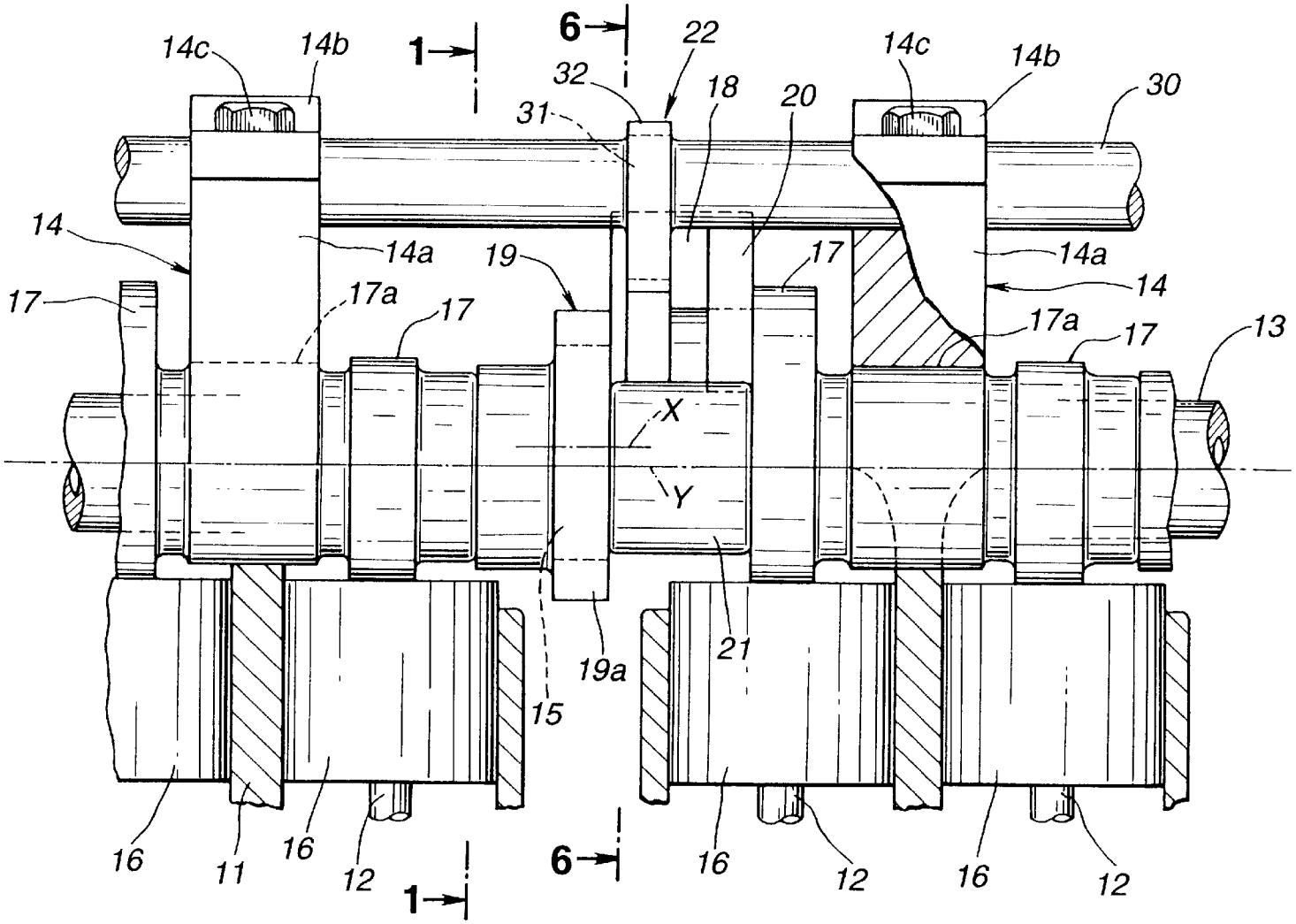
FIG. 2 is a side view of a portion of the VVA apparatus.
Figure 3:
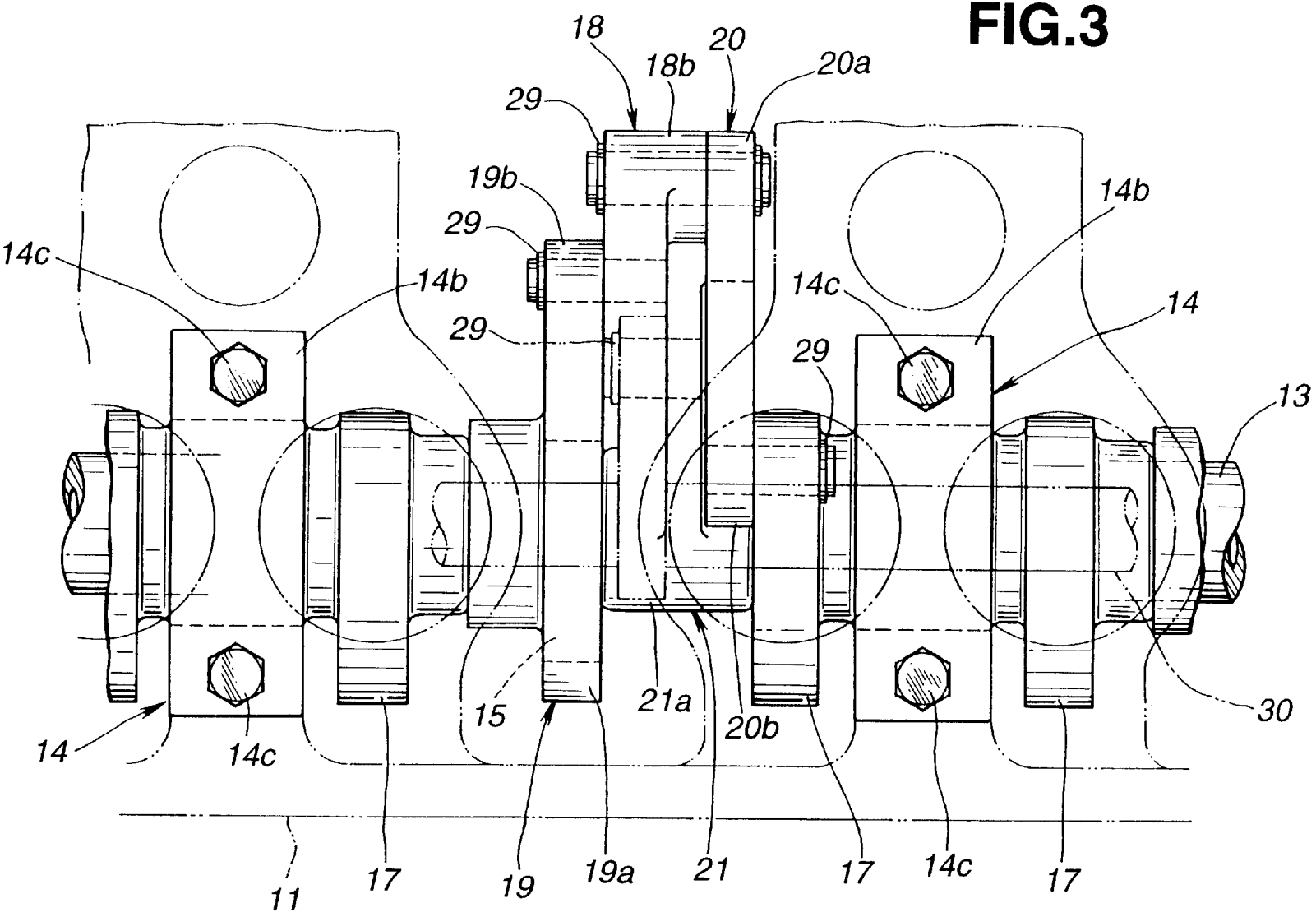
FIG. 3 is a plan view of a portion of the VVA apparatus.

Referring to FIGS. 1 to 3, the reference numeral 11 designates a cylinder head of an overhead camshaft internal combustion engine. The engine has four cylinder valves per cylinder. They include two intake valves 12, 12 and two exhaust valves (not shown). Valve guides, not shown, of the cylinder head 11 support the intake valves 12, 12, respectively.

Referring to FIGS. 1 to 5, the first embodiment of a VVA apparatus according to the present invention is described. The VVA apparatus comprises a hollowed drive shaft 13. The drive shaft 13 is supported by bearings 14 on top of the cylinder head 11 for rotation about a drive shaft axis Y. The drive shaft 13 carries drive cams, only one being shown at 15, arranged for the cylinders, respectively. Each drive cam is in the form of an eccentric rotary (ER) cam that is fixed, by press fitting, to the drive shaft 13 and has a center X displaced from the drive shaft axis Y. The reference numerals 16 designate valve lifters of the cylinder valves 12, respectively. The VVA apparatus also comprises a pair of valve operating (VO) cams 17, 17 for each cylinder of the engine to activate the valve lifters 16, 16 of the cylinder valves 12, 12 for the particular cylinder. The VVA apparatus comprises a rocker arm 18, a crank arm 19, a link rod 20 and a supporting arm 21 for each pair of VO cams 17, 17. At one end 18*a*, the rocker arm 18 is connected to the crank arm 19 supported by the drive cam 15. At the other end 18*b*, the rocker arm 18 is connected via the link rod 20 to the VO cams 17, 17. At a base end portion 21*a*, the supporting arm 21 is supported by the drive shaft 13 for rotation about the drive shaft Y. At a leading end 21*b*, the supporting arm 21 supports the rocker arm 18 at a pivot center 18*c* between the both ends 18*a* and 18*b* to allow the rocker arm 18 to rotate about this pivot point 18*c*. As the discussion proceeds, it will be noted that rotational motion of the supporting arm 21 about the drive shaft axis Y causes the pivot center 18*c* of the rocker arm 18 to rotate around the drive shaft axis Y. A supporting arm (SA) actuator 22 positions in angular direction the supporting arm 21 in response to a control signal. An electronic controller is provided. Sensors on the engine send information on engine speed, engine load, vehicle speed, and coolant temperature to the controller. At a predetermined switchover point, the controller sends the control signal to the SA actuator 22.

The drive shaft 13 extends along a longitudinal direction of the engine. At one end, the drive shaft 13 is drivingly connected to the engine crankshaft through a sprocket and timing chain assembly.

Figure 4:
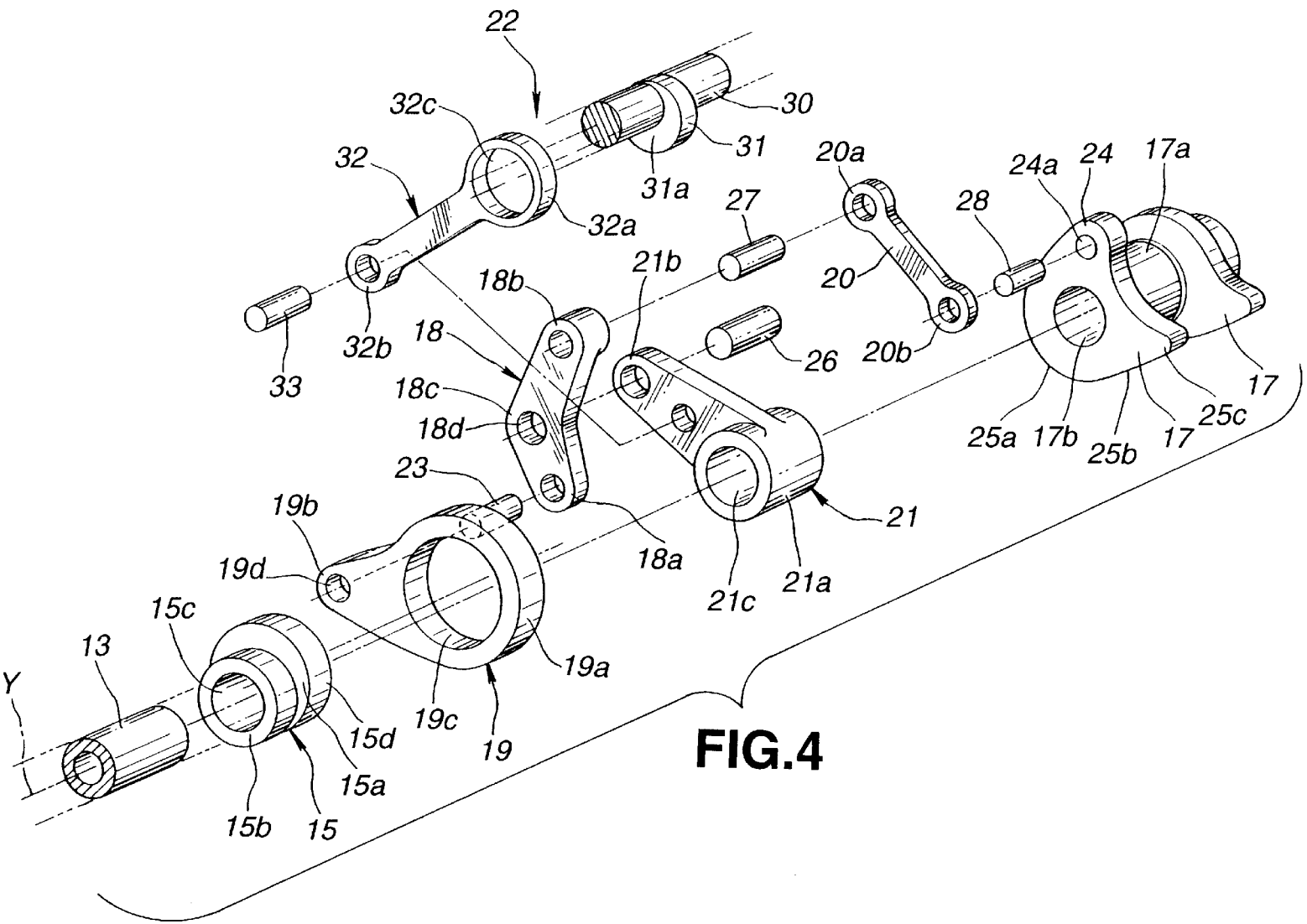
FIG. 4 is an exploded view of the VVA apparatus.

As best seen in FIG. 4, the drive cam 15 has a generally ring-like configuration. It includes an enlarged diameter cam main body 15*a* and an integral hub 15*b*, which extends from one axial end face of the cam main body 15*a*. Bored through the cam main body 15*a* and the hub 15*b* is an axial bore 15*b*, which receives the drive shaft 13. The drive cam 15 is mounted to the drive shaft 13 with the center X of the cam main body 15*a* displaced from the drive shaft axis Y in a radial direction by a predetermined amount. The drive cam 15 is fixed to the drive shaft 13 by press fitting the drive shaft 13 into the bore 15*b* at a location where it does not interfere with the adjacent valve lifters 16.

The crank arm 19 includes an annular base 19*a* and an integral protrusion 19*b* extending from a predetermined location on an outer peripheral surface of the annular base 19*a* in a radial outward direction. The annular base 19*a* is formed with a central bore 19*c*. The protrusion 19*b* is formed with a hole 19*d*. The central bore 19*c* receives the cam main body 15*a* for allowing rotation of the crank arm 19 relative to the drive cam 15 about the center X. A pin 23 is inserted into the hole 19*d* for relative rotation of the pin 23 relative to the crank arm 19.

Figure 5:
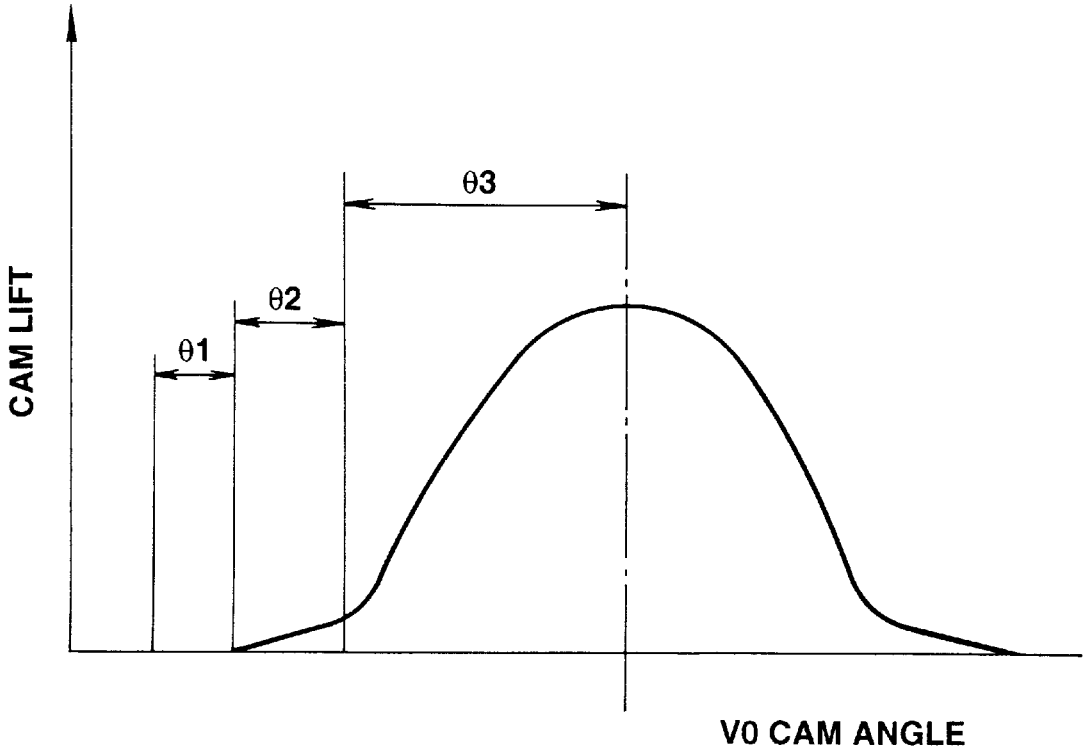
FIG. 5 illustrates a cam lift versus VO cam angle characteristic of the VO cam.

The VO cams 17, 17 of each set are interconnected by a sleeve 17*a* and extend outwardly along radial direction from one and the other axial ends of the sleeve 17*a*. The sleeve 17*a* is formed with a bore 17*b*. The drive shaft 13 extends through the bore 17*b* for allowing rotation of the VO cams 17, 17 relative thereto. One of the VO cams 17 that extends from and defines one axial end 24 is formed with a hole 24*a*. This axial end 24 is mounted near the adjacent rocker arm 18. Each VO cam 17 has a downwardly facing peripheral surface that extends below the bore 17*b*. This downwardly facing peripheral surface of each VO cam 17 includes a circular base face 25*a* on the base portion 17*a* and a cam face 25*b*. The cam face 25*b* extends from the circular base face 25*a* outwardly toward an edge 25*c* of the VO cam 17. The cam face 25*b* elevates from the level of the circular base face 25*b* gradually toward the edge 25*c*. Pivotal motion of the VO cam 17 brings the circular base and cam faces 25*a* and 25*b* into abutting contact with a predetermined location on top face of the adjacent valve lifter 16. FIG. 5 illustrates a valve lift diagram of the VO cam 17. Referring to the valve lift diagram, there are three periods, namely a base circle period, a ramp period and a lift period. The base circle period lasts during rotation of the VO cam 17 through a first predetermined angle θ1. The ramp period lasts during the subsequent rotation of the VO cam 17 through a second predetermined angle θ2. The lift period lasts during the subsequent rotation of the VO cam 17 through a predetermined angle θ3. The setting is made such that the VO cams 17, 17 rotate in a direction opposite to direction of rotation of the drive shaft 13 for moving the valve lifters 16, 16 in a lift direction.

As shown in FIGS. 1–3, each of the bearings 14 includes a main bracket 14*a*, a sub-bracket 14*b* and a pair of bolts 14*c*, 14*c*. As best seen in FIG. 2, the main brackets 14*a* hold the drive shaft 13 at the sleeves 17*a* each interconnecting the VO cams of one set. The main and sub-brackets 14*a* and 14*b* of each bearing 14 interpose between them a control shaft 30, which is later described in connection with the SA actuator 22. The pair of bolts 14*c*, 14*c* extends through the main and sub-brackets 14*a* and 14*b* to fix them to the cylinder head 11.

Each of the rocker arms 18 is a lever curved at its pivot center 18*c* and extends generally along a centerline of the adjacent cylinder. A pin 26 interconnects the pivot center 18*c* of the rocker arm 18 and the leading end 21*b* of the supporting arm 21 to provide relative rotational relation therebetween. A pin 23 interconnects the one end 18*a* of the rocker arm 18 and the protrusion 19*b* of the crank arm 19 to provide relative rotational relation therebetween. A pin 27 interconnects the other end 18*b* of the rocker arm 18 and the one end 20*a* of the link rod 20 to provide relative rotational relation therebetween.

Each of the link rods 20 extends over a predetermined dimension along a straight line. At one end the other ends 20*a* and 20*b*, the link rod 20 is enlarged to define circular portions. A pin 27 interconnects the end 20*a* of the link rod 20 and the end 18*b* of the rocker arm 18 to establish relative rotational relation therebetween. A pin 28 is inserted into the hole 24*a* (see FIG. 4) to interconnect the end 20*b* of the link rod 20 and the VO cams 17, thereby to provide relative rotational relation therebetween.

Turning back to FIG. 1, suppose a line segment Z1 that interconnects the drive shaft axis Y about which the VO cams 17 rotate and the centerline of the pin 28 and extends within a radial plane with respect to the drive shaft axis Y. Also suppose a line segment Z2 that interconnects the centerline of the pin 28 and the centerline of the pin 27 and extends within the same radial plane. In the illustrated arrangement, the line segments Z1 and Z2 form an angle θ. This angle θ varies within a predetermined range during pivotal motion of the VO cam 17 about the drive shaft axis Y. Snap rings 29 are provided to prevent removal of each of the pins 23, 26 and 27.

As readily seen from FIGS. 1 and 4, each of the supporting arm 21 includes a flat elongated straight plate extending from a hub 21*a* with a bore 21*c*. The supporting arms 21 extend generally along a traverse direction of the engine. The drive shaft 13 extends through the bores 21*c* of the hubs 21*a* of the supporting arms 21 to provide relative rotational relation between each supporting arm 21 and the drive shaft 13. In FIG. 4, the pin 26 is inserted into a hole 18*d* of the pivot center 18*c* of the rocker arm 18 to interconnect the leading end 21*b* of the supporting arm 21 and the pivot center of the rocker arm 18. The hub 21*a* is located between the drive cam 15 and the VO cam 17 (see FIG. 2).

The SA actuator 22 is designed to move each supporting arm 21 in the same rotational direction of the drive shaft 13 during operation cause a shift from a large lift mode to a small lift mode. Viewing in FIG. 1, the drive shaft 13 rotates counterclockwise as indicated by an arrow.

The SA actuator 22 includes the before mentioned control shaft 30 that is interposed between the main brackets 14*a* and the sub-brackets 14*b*. The control shaft 30 has spaced control cams 31. The control cams 31 are fixed to the control shaft 30 for motion as a unit with rotary motion of the control shaft 30 about its centerline P1. The SA actuator 22 also includes control links 32, each of which interconnects one of the control cams 31 and the associated supporting arm 21. An electromagnetic actuator, not shown, is provided to position the control shaft 30 in an angular direction about the centerline P1 thereof.

As best seen in FIG. 4, each control cam 31 is in the form of a circular cam having a cylindrical outer peripheral wall. Each circular cam 31 is fitted around outer peripheral surface of the control shaft 30 and extends in radial outward directions. Each circular cam 31 has a centerline P2, which is displaced from the centerline P1 of the control shaft 30 by an amount α (alpha) as shown in FIG. 1.

Each control link 32 has an enlarged circular end 32*a* formed with a circular hole 32*c* and a less enlarged circular end 32*b*. A straight elongate plate interconnects the circular ends 32*a* and 32*b*. Each control cam 31 is disposed in the hole 32*c* of the enlarged circular end 32*a* of one of the control links 32 to provide relative rotation of the control link with respect to the control cam 31. A pin 33 interconnects the less enlarged circular end 32*b* of one of the control links 32 and the associated supporting arm 21 to provide relative rotational relation therebetween. The pin 33 is connected to the supporting arm 21 at a point between the leading end 21*b* and the hub 21*a*.

At one end, the control shaft 30 is connected to the electromagnetic actuator. The electromagnetic actuator can rotate the control shaft 30 within a predetermined angular range in response to control signal from the controller.

Referring to FIGS. 1, 6, 7A and 7B, the VVA apparatus operates as follows.

Figure 6:
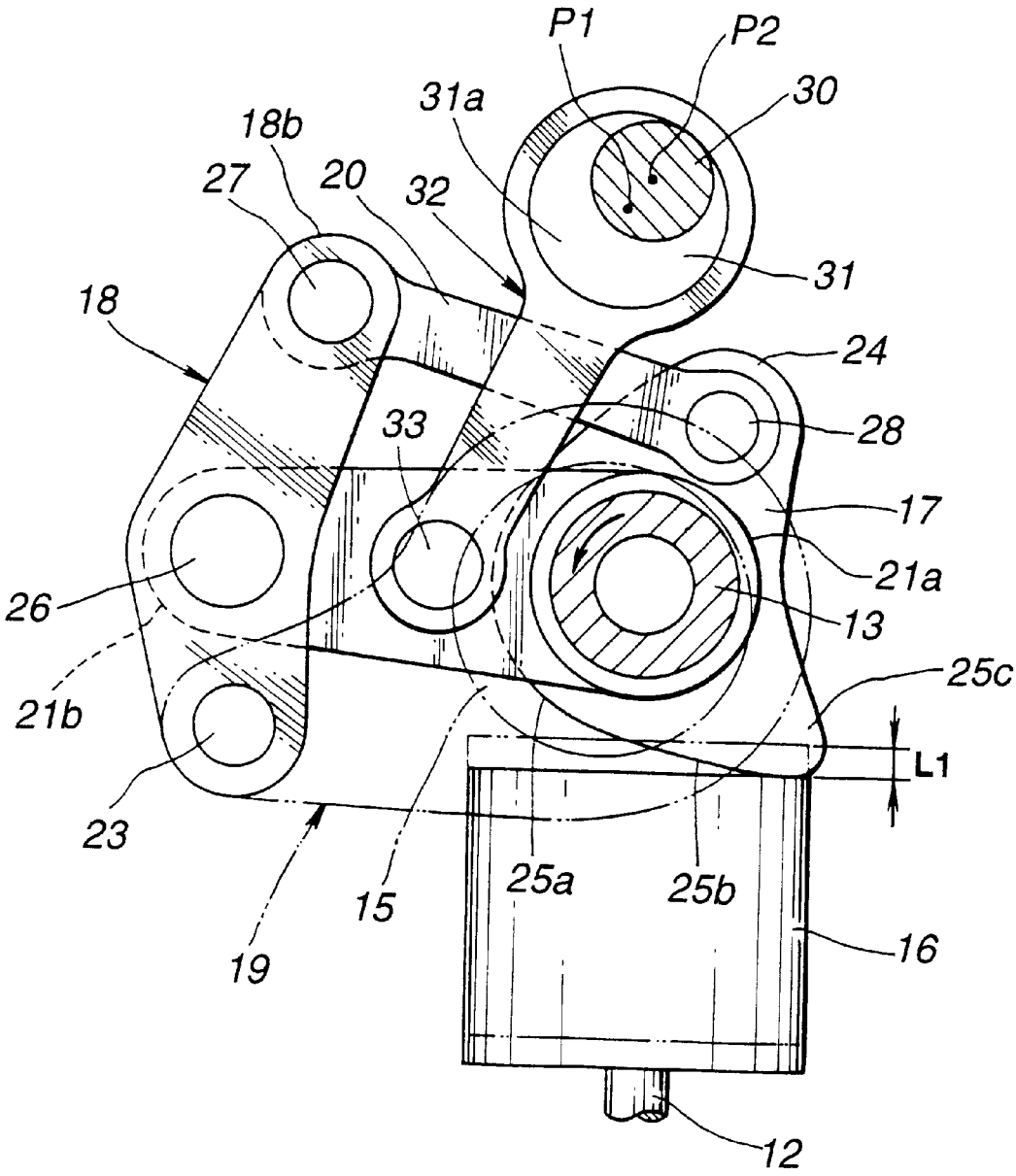
FIGS. 6, 7A and 7B illustrate operating positions of the VVA apparatus.
Figure 7A:
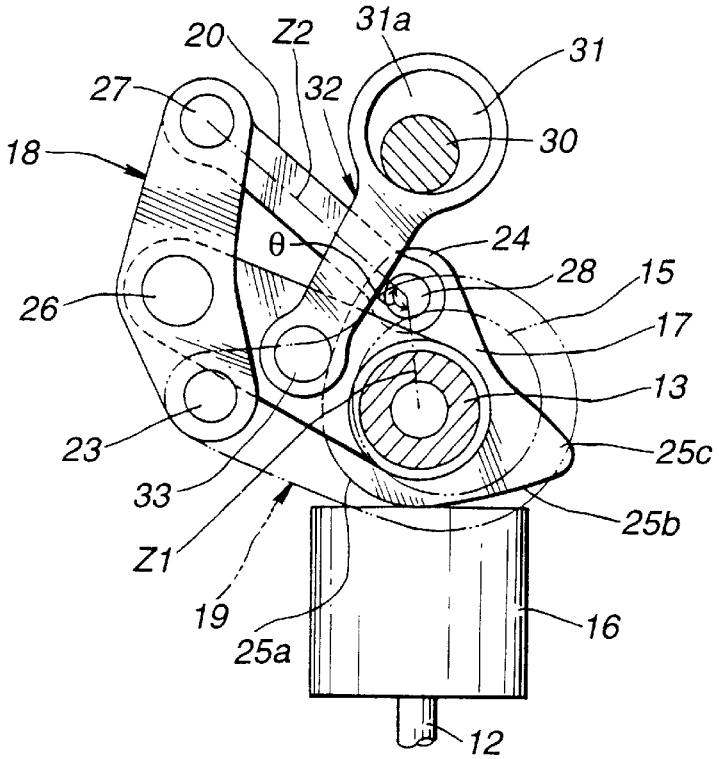
Figure 7B:
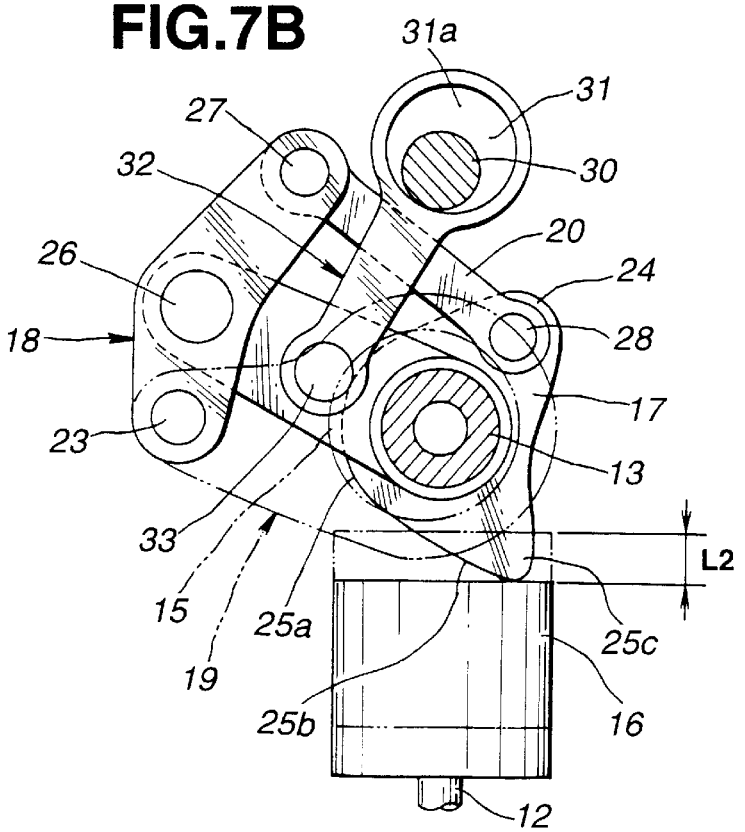

FIGS. 1 and 6 illustrate position of parts of the VVA apparatus during low lift mode, which is fit for engine operation at low speeds with light load. FIGS. 7A and 7B illustrate position of parts of the VVA apparatus during high lift mode, which is fit for engine operation at high speeds with heavy load.

For a shift from engine operation at high speeds with heavy load to engine operation at low speeds with light load, the controller sends control signal to the SA actuator 22 thereby to cause the electromagnetic actuator to rotate in one direction. This rotation of the electromagnetic actuator causes the control shaft 30 and each control cam 31 to rotate about the centerline P2, causing the centerline P1 of each control cam 31 to move about the centerline P2 to the illustrated position in FIGS. 1 and 6. In the position of FIGS. 1 and 6, the control cam 31 is held in an angular position with its centerline P1 located at a left and downward position with respect to the centerline P2, thereby to position its thickened portion 31*a* near the drive shaft 13. This movement of the control cam 31 causes the associated supporting arm 21 to move about the drive shaft axis Y down to the horizontal position as illustrated in FIGS. 1 and 6. This downward movement of the supporting arm 21 causes the associated rocker arm 18 to move down to the position as illustrated in FIGS. 1 and 6. This downward movement of each rocker arm 18 rotate the associated VO cams 17, 17 in such a direction as to lift their edges 24 (counterclockwise rotation viewing in FIGS. 1 and 6).

Under this condition, rotation of the drive shaft 13 counterclockwise viewing in FIGS. 1 and 6 causes eccentric motion of each drive cam 17 between two representative positions as illustrated in FIGS. 1 and 6, respectively. This eccentric motion of the drive cam 17 causes reciprocating motion of the associated crank arm 19 between two representative positions as illustrated in FIGS. 1 and 6, respectively. This causes the rocker arm 18 to pivot between its pivot center 18*c* that is supported at the leading end 21*b* of the supporting arm 21. The rocker arm 18 can pivot between the two representative positions as illustrated in FIGS. 1 and 6. The pivotal motion of the rocker arm 18 is transmitted via the link rod 20 to the associated VO cams 17, 17, causing the VO cams 17, 17 to pivot between the as illustrated in FIGS. 1 and 6. FIG. 6 illustrates the position of parts to provide a maximum valve lift L1 during small lift mode for engine operation at low speeds with light load. The maximum valve lift L1 is relatively small as compared to a maximum valve lift, which is provided during large lift mode for engine operation at high speeds with heavy load.

Figure 8:
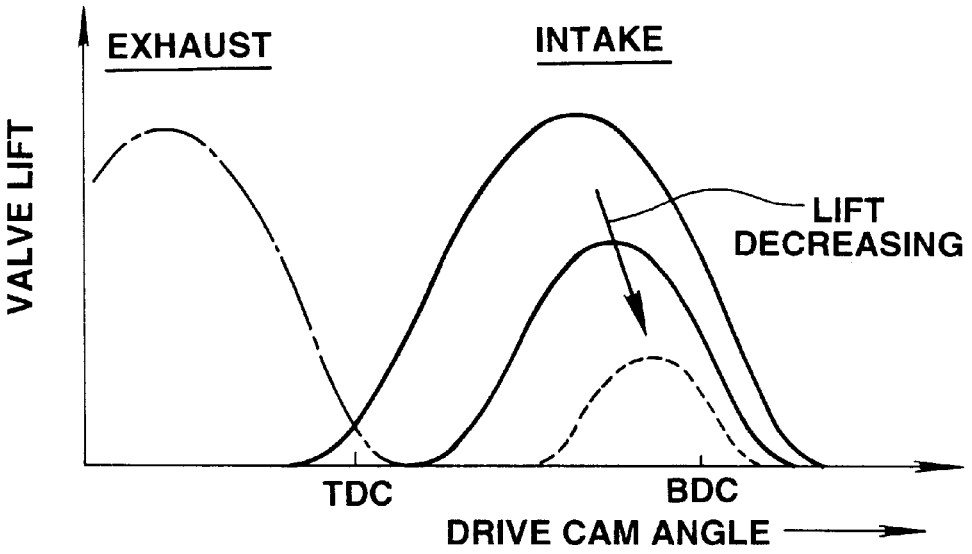
FIG. 8 illustrates valve lift diagrams according to the first embodiment.

FIG. 8 illustrates change in valve lift diagram of the associated intake valve as the VVA apparatus shifts from large lift mode as illustrated in FIGS. 7A and 7B to small lift mode as illustrated in FIGS. 1 and 6. In FIG. 8, the fully drawn curve with the highest valve lift illustrates a valve lift characteristic during large lift mode. The dotted line drawn curve with the smallest valve lift illustrates a valve lift characteristic during small lift mode. A fully drawn curve between them illustrates a valve lift characteristic during transient between the two modes. The phantom line drawn curve illustrates an unaltered valve characteristic of exhaust valve. From these curves in FIG. 8, it will now be appreciated that the valve lift becomes the smallest and open timing of the intake valve 12 becomes delayed and valve opening duration becomes small during small lift mode as compared to those during large lift mode. Delaying the valve open timing in this manner results in reduction in valve overlap with the exhaust valve, thereby to provide improved fuel economy and improved engine stability during engine operation at low speeds with light load.

For a shift from small lift mode to large lift mode for engine operation at high speeds with heavy load, the controller sends control signal to the SA actuator 22 thereby to cause the electromagnetic actuator to rotate in the opposite direction. This rotation of the electromagnetic actuator causes the control shaft 30 to rotate each control cam 31 clockwise from the position as illustrated in FIGS. 1 and 6 to the position as illustrated in FIGS. 7A and 7B through about 180 degrees. This results in movement of the centerline P1 of the control cam 31 about the centerline P2 of the control shaft 16 to the illustrated position in FIGS. 7A and 7B. In the position of FIGS. 7A and 7B, the control cam 31 is held in an angular position with its centerline P1 located at a right and upward position with respect to the centerline P2, thereby to position its thickened portion 31*a* far away from the drive shaft 13. This movement of the control cam 31 causes the associated supporting arm 21 to move about the drive shaft axis Y up to the horizontal position as illustrated in FIGS. 7A and 7B. This upward movement of the supporting arm 21 causes the associated rocker arm 18 to move up to the position as illustrated in FIGS. 7A and 7B. This upward downward movement of each rocker arm 18 rotates clockwise the associated VO cams 17, 17 in such a direction as to lower their edges 24.

Comparing the illustrated position in FIG. 7A with the illustrated position in FIG. 1 reveals that the cam surface 25*b* is more close to the top face of the associated valve lifter 18 during large lift mode than it is during small lift mode. During large lift mode, therefore, eccentric motion of each drive cam 17 due to rotation of the drive shaft 13 provides an increased valve lift L2 of the valve lifter 16. The valve lift L2 is larger than the valve lift L1.

During large lift mode for engine operation at high speeds with heavy load, the VVA apparatus provide a valve lift characteristic as indicated by the fully drawn curve with the largest valve lift in FIG. 8. According to this valve lift characteristic, the valve lift has become larger than that during small lift mode and valve open timing of each intake valve 12 has advanced with valve close timing delayed. As a result, the VVA apparatus provides increased volumetric efficiency and increased power output.

Figure 9:
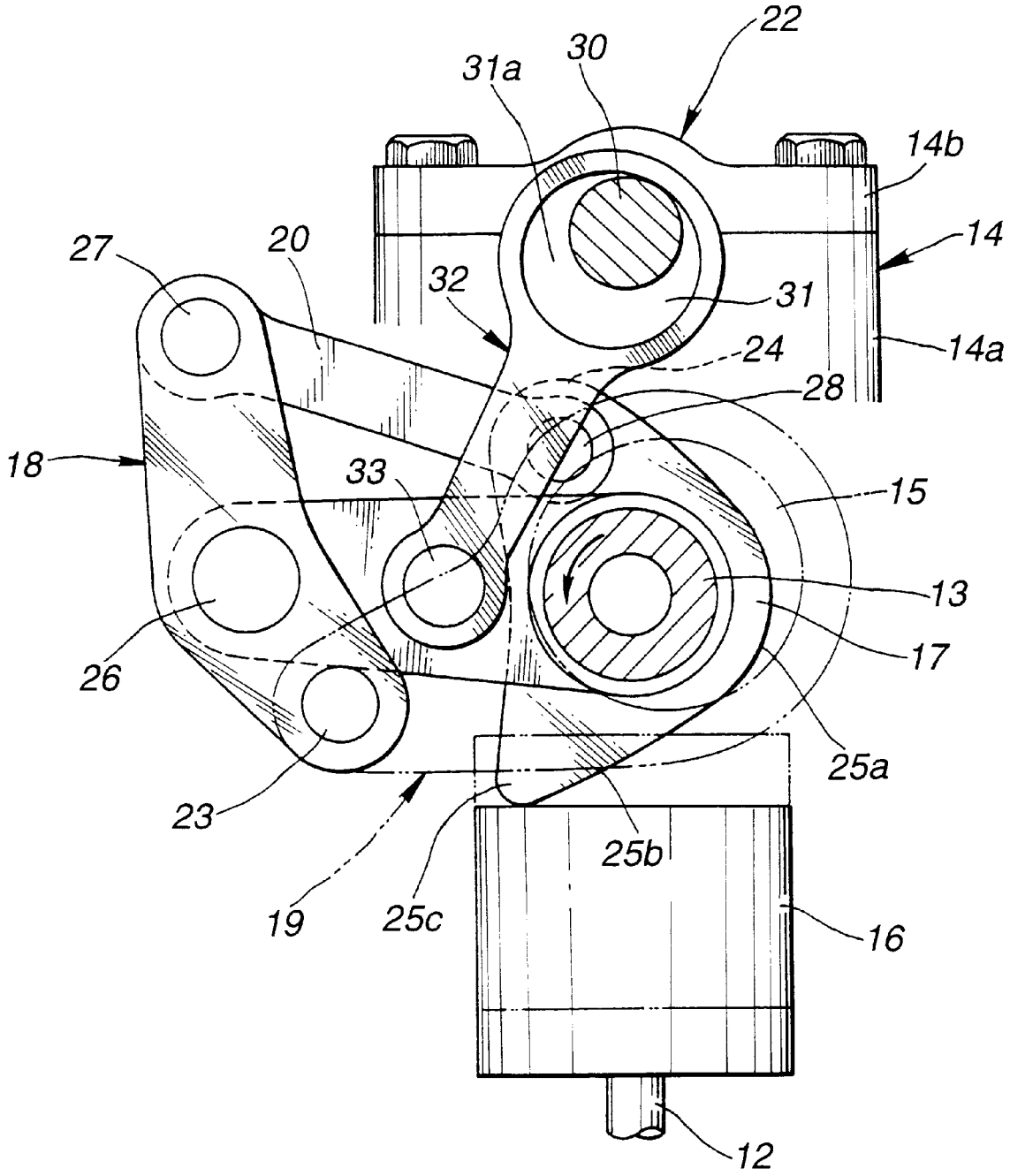
FIG. 9 is a similar view to FIG. 1 illustrating a second embodiment of a VVA apparatus according to the present invention.

FIG. 9 illustrates the second embodiment of VVA apparatus according to the present invention. This embodiment is substantially the same as the first embodiment previously described. In the first embodiment, each supporting arm 21 has moved along direction of rotation of the drive shaft 13 during shift from large lift mode to small lift mode. As different from the first embodiment, according to the second embodiment, each supporting arm 21 is arranged to move in direction opposite to direction of rotation of the drive shaft 13 during shift from large lift mode to small lift mode. In the first embodiment, each VO cam 17 has pivoted in a direction opposite to direction of rotation of the drive shaft 13 upon moving the associated valve lifter 16 in downward or lift direction. However, as different from the first embodiment, according to the second embodiment, each VO cam 17 is arranged to pivot along direction of rotation of the drive shaft 13 upon moving the associated valve lifter 16 in downward or lift direction. In other words, direction of pivotal motion of each VO cam 17 to move the valve lifter 16 in its lift direction is the opposite to direction of rotational movement of each supporting arm 21 to make a shift from large lift mode to small lift mode.

According to the second embodiment, each rocker arm 18 rotates in the direction opposite to the direction of rotation of the drive shaft 13 to make a shift from large lift mode to small lift mode. This provides a valve lift characteristic as illustrated by the fully drawn curve with the smallest valve lift in FIG. 10.

Figure 10:
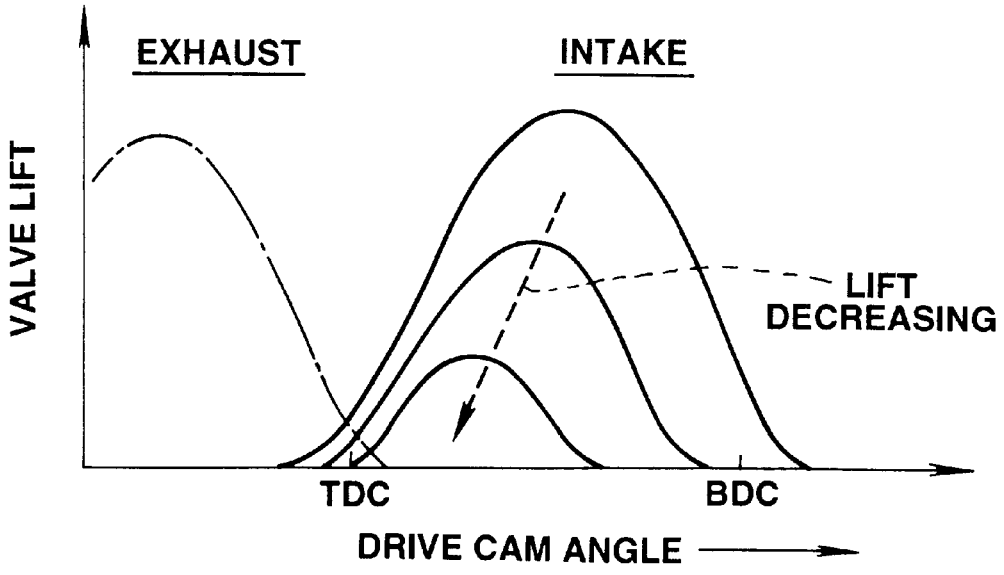
FIG. 10 illustrates valve lift diagrams according to the second embodiment.

Comparing FIG. 10 with FIG. 8 reveals that, during small lift mode, the valve opening duration occurs during initial half portion of piston intake stroke according to the first embodiment, while the valve opening duration occurs during the subsequent half portion of piston intake stroke according to the second embodiment.

If, during small lift mode for engine operation at low speeds with light load, the valve open timing is delayed considerably as shown in FIG. 8, the intake valve 12 remains closed until the initial half of piston downward stroke ends, resulting in vacuum build-up in the cylinder. Thus, when the intake valve 12 opens subsequently, the vacuum created in the cylinder draws intake air rapidly into the cylinder, creating strong flow of charge within the cylinder, thereby to facilitate combustion of the charge. This operation meets demand for improved combustion required during cold engine after start-up or during engine operation at low speed with light load.

If, during small lift mode for engine operation at low speeds with light load, the valve close timing is advanced considerably as shown in FIG. 10, the intake valve 12 is closed during the last half of piston downward stroke. Thus, with less throttling by the engine throttle valve, intake charge can be adjusted to a desired amount required for engine operation at low speed with light load. This results in considerable reduction in pump loss.

From the preceding description of the first and second embodiments, it will be appreciated that a shift between the small lift mode and large lift mode is accomplished by moving the pivot center 18*c* of each of rocker arm 18 along a circle about the driver shaft axis Y. The distance between the pivot center 18*c* of the rocker arm 18 and the drive shaft axis X remains unaltered during the shift. Thus, the angle θ (see FIG. 1) is restrained from varying outside the predetermined range even if each supporting arm 21 takes any angular position to position the pivot center 18*c* of the associated rocker arm 18. The predetermined range of angle is determined to ensure smooth articulation between each link rod 20 and the associated VO cam 17 in transmitting motion of the associated rocker arm 18.

Figure 11:
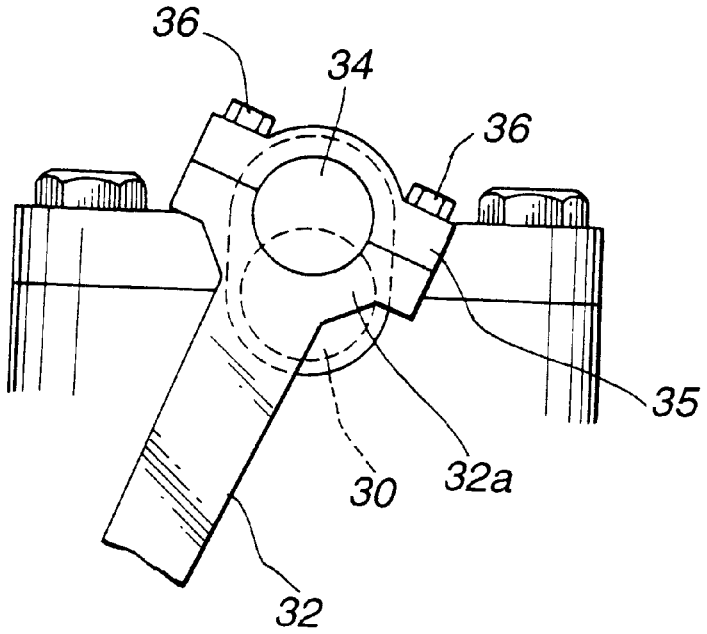
FIG. 11 illustrates a portion of a third embodiment according to the present invention.
Figure 12:
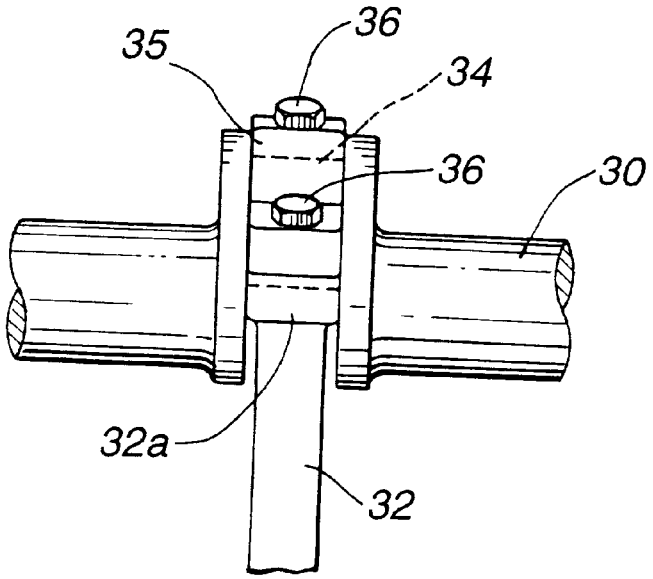
FIG. 12 illustrates the third embodiment in another angle.

FIGS. 11 and 12 illustrate a portion of the third embodiment of VVA apparatus. This third embodiment is substantially the same as the first embodiment or second embodiment except connection between a control shaft 30 and each control link 32. In the first or second embodiment, each control cam 34 has been in the form of an eccentric rotary cam. As different from the preceding embodiments, according to the third embodiment, the control shaft 30 has crank portions to define control cams 34 instead of eccentric rotary cams. To mount an end portion 32*a* of each control link 32 around the associated crank portion 34, the end portion 32*a* is recessed to receive the crank portion 34 and cooperates with a bearing bracket 35. The bearing bracket 35 is fixed to the end portion 32*a* of the control link by means of bolts 36 to interpose therebetween the crank portion 34.

According to the third embodiment, the amount of eccentricity required for proper operation of the VVA apparatus is ensured without eccentric rotary cams by compact configuration of the connection between each control link and the control shaft. This provides compact SA actuator 22, making contribution to a reduction in the overall height of the engine.

Figure 13:
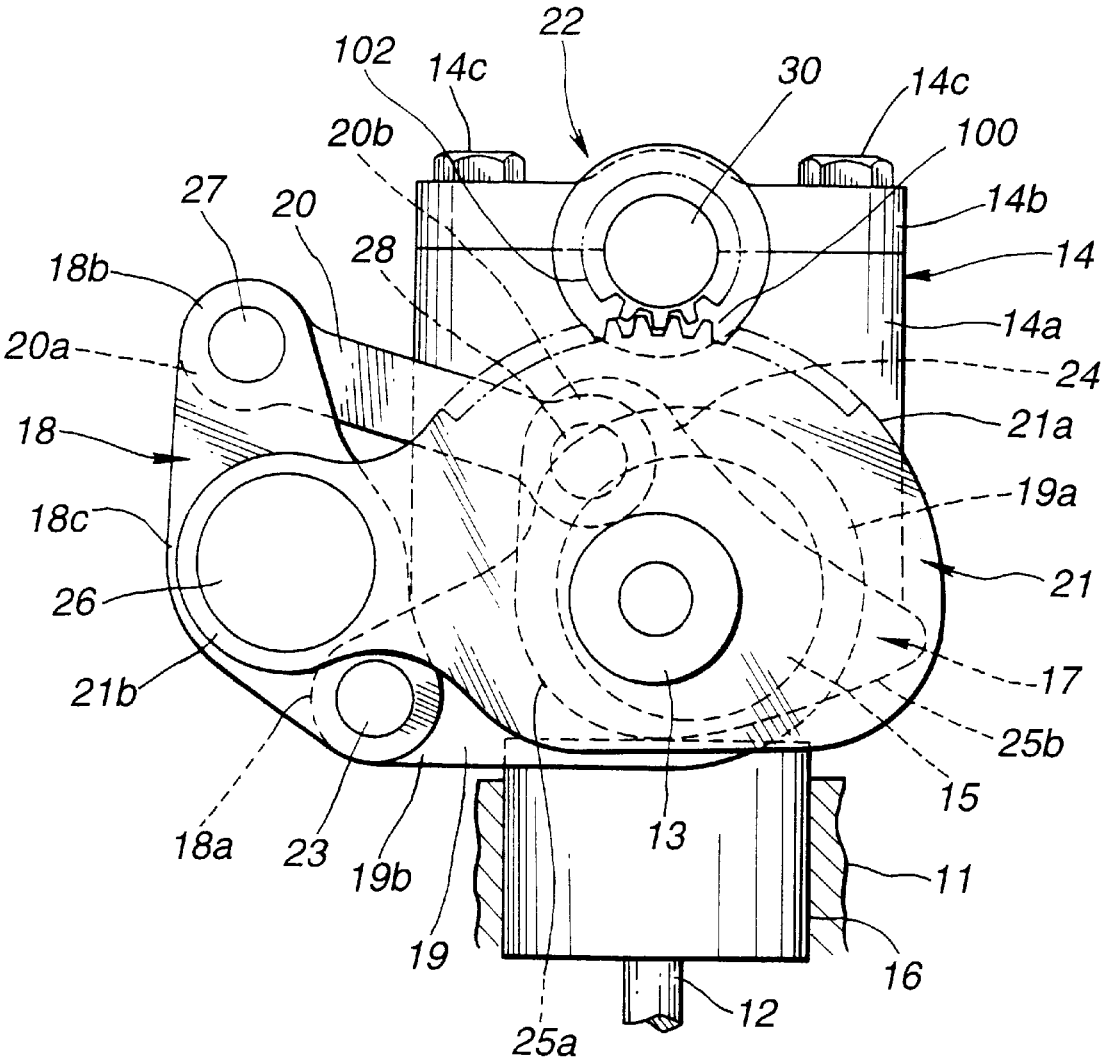
FIG. 13 is a similar view to FIG. 1 illustrating a fourth embodiment of a VVA apparatus according to the present invention.
Figure 14:
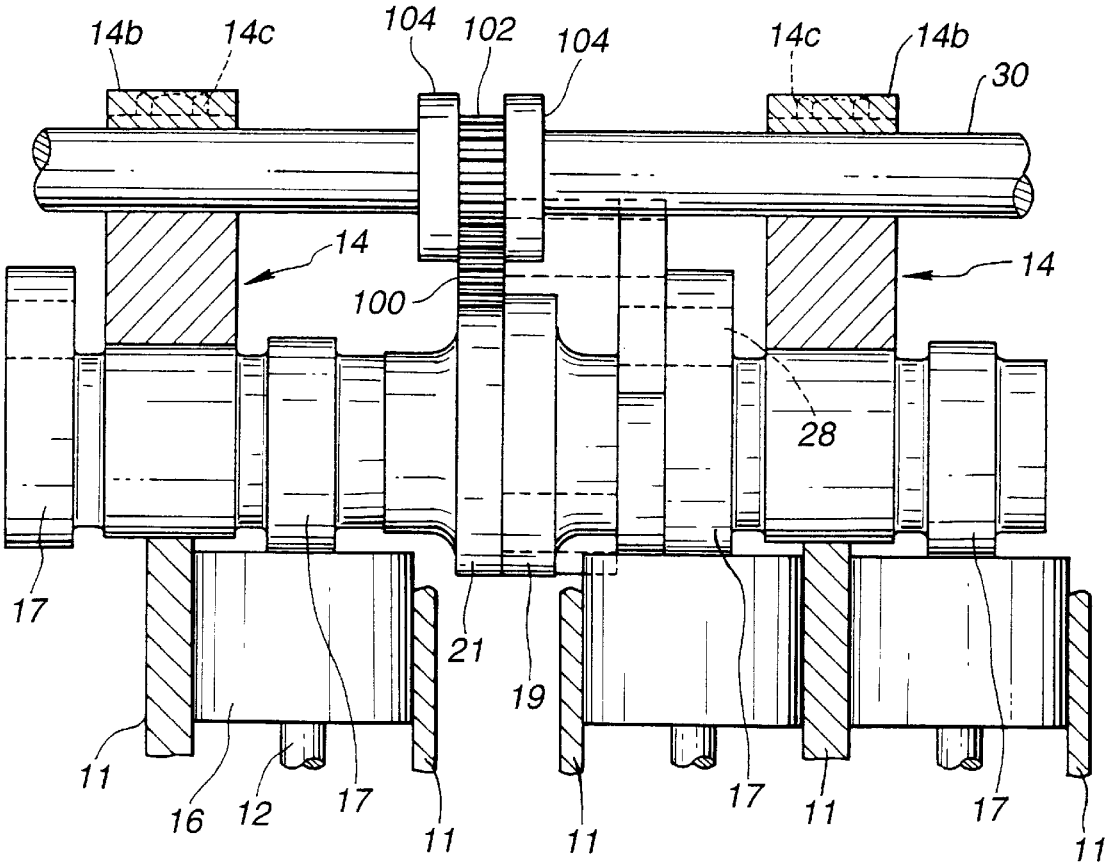
FIG. 14 is a side view of a portion of the VVA apparatus shown in FIG. 13.
Figure 15:
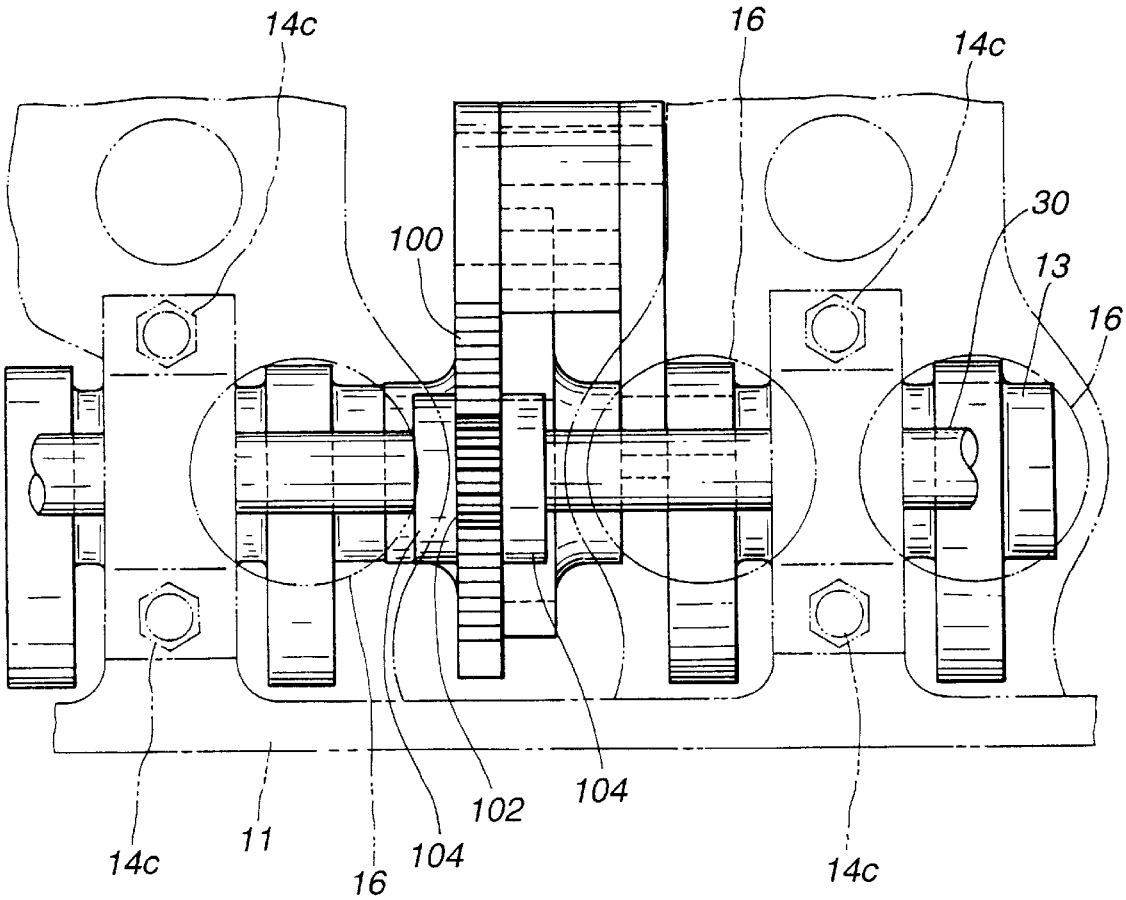
FIG. 15 is a plan view of a portion of the VVA apparatus shown in FIG. 13.

FIGS. 13 to 15 illustrate the fourth embodiment of VVA apparatus according to the present invention. The fourth embodiment is substantially the same as the first embodiment except the mechanism of SA actuator 22. According to the SA actuator of this embodiment, the control cams 34 and control links 32 have been replaced with modified supporting arms 21 with follower gear teeth 100 and drive pinions 102 on a control shaft 30.

As seen in FIGS. 14 and 15, the control shaft 30 has a pair of axially spaced flanges 104, 104 in a manner to interpose therebetween the pinion 102 to prevent disengagement of the pinion 102 from the follower gear teeth 100.

Figure 16:
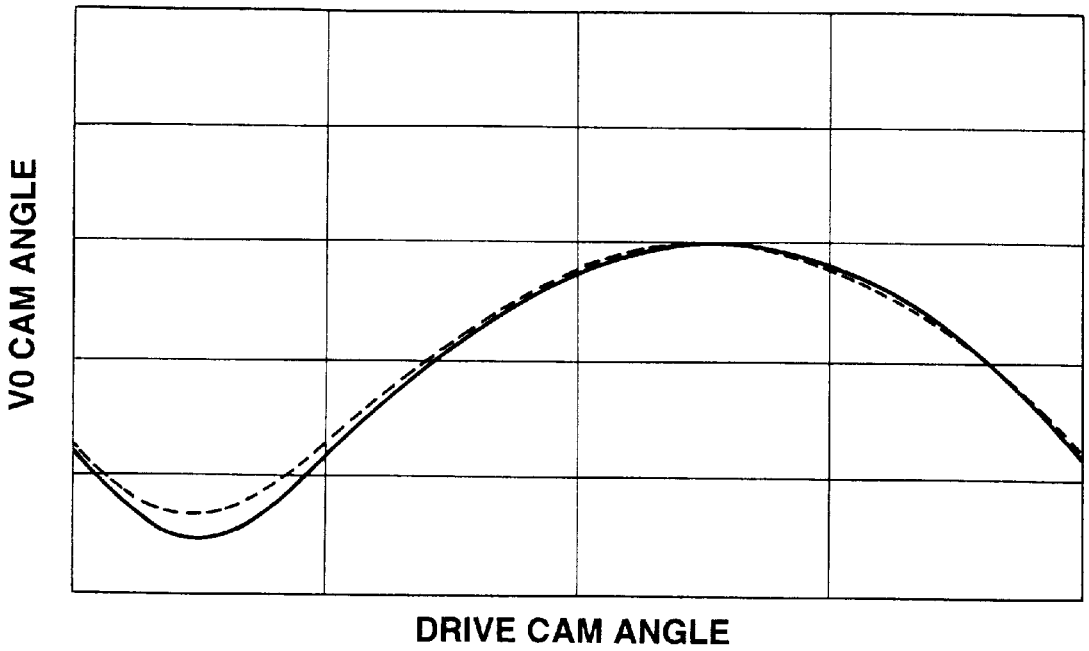
FIG. 16 illustrates VO cam angle versus drive shaft angle characteristic curves used to evaluate motion of the VO cam.

Referring to FIG. 16, the dotted line curve illustrates a VO cam angle versus drive cam angle characteristic according to the present invention. It will be appreciated that, according to the preceding embodiments, operating angle of the VO cam does not change after a shift from the low lift mode operation to the high lift mode operation. Thus, the VO cam angle versus drive cam angle characteristic as shown by the dotted line curve is maintained over the low lift and high lift modes. This is particularly advantageous in improving smooth operation of the VO cam and the associated valve lifter during high lift mode operation. In FIG. 16, the fully drawn curve illustrates a VO cam angle versus drive cam angle characteristic if the operating angle of the VO cam is increased during high lift mode operation. Comparing the fully drawn curve with the dotted line curve reveals that acceleration at which the VO cam is moved increases during high valve lift mode operation due to increased operating angle of the VO cam.

Figure 17:
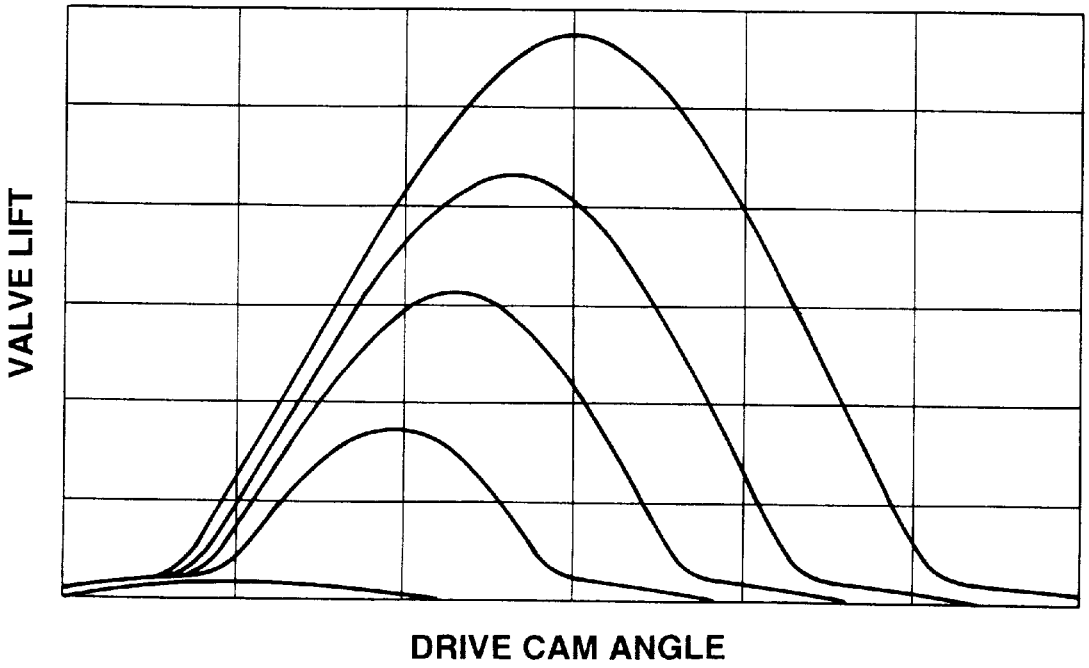
FIG. 17 illustrates a family of valve lift versus drive shaft angle characteristic curves according to the fourth embodiment.

FIG. 17 illustrates a family of valve lift versus drive cam angle characteristic curves, similar to FIG. 10, of the fourth embodiment. It will be noted that, according to the fourth embodiment, any desired characteristic of this family can be selected by the SA actuator because supporting arms 21 may be positioned at any desired angle position.

The content of disclosure of Japanese Patent Application No. 9-338319 filed Dec. 9, 1997 and that of Japanese Patent Application No. 10-67526 are hereby incorporated by reference in their entireties.

What is claimed is:

1. A variable valve actuator (VVA) apparatus for operating a cylinder valve of an engine, comprising:

a drive shaft having a drive shaft axis for rotation thereabout;

a drive cam on said drive shaft for rotation therewith about said drive shaft axis;

a valve operating (VO) cam on said drive shaft for pivot motion about said drive shaft axis;

a link mechanism interconnecting said drive cam and said VO cam, said link mechanism being bodily movable along a circle about said drive shaft axis; and an actuator to position said link mechanism to different positions on said circle.

2. The VVA apparatus as claimed in claim 1, wherein said link mechanism includes:

a supporting arm supported by said drive shaft;

a rocker arm having a pivot center thereof supported by said supporting arm;

a crank arm connected between said rocker arm and said drive cam;

a link rod connected between said rocker arm and said VO cam.

3. The VVA apparatus as claimed in claim 1, wherein said actuator includes:

a control shaft extending in parallel to said drive shaft, said control shaft mounted for rotation;

a motion transmitting unit for moving said link mechanism along said circle in response to rotation of said control shaft.

4. The VVA apparatus as claimed in claim 3, wherein said motion transmitting unit includes:

a pinion on said control shaft; and follower gear teeth on said link mechanism meshing with said pinion.

5. The VVA apparatus as claimed in claim 4, wherein said control shaft includes a pair of axially spaced flanges having interposed therebetween said pinion to prevent disengagement of said pinion from said follower gear teeth.

6. The VVA apparatus as claimed in claim 3, wherein said motion transmitting unit includes:

a control cam on said control shaft; and a control link connected between said control cam and said supporting arm to position said supporting arm in response to rotation of said control cam.

7. The VVA apparatus as claimed in claim 6, wherein said supporting arm is interposed between said drive cam and said VO cam on said drive shaft.

8. The VVA apparatus as claimed in claim 6, wherein the supporting arm rotates in the same direction as that of said drive shaft during a shift from a high lift mode operation to a small lift mode operation.

9. The VVA apparatus as claimed in claim 6, wherein the supporting arm rotates in a direction opposite to direction of rotation of said drive shaft during a shift from a high lift mode operation to a small lift mode operation.

* * * * *